US006528027B1

(12) United States Patent
Brewer et al.

(10) Patent No.: US 6,528,027 B1
(45) **Date of Patent: *Mar. 4, 2003**

(54) CRACKING FURANCE HAVING RADIANT HEATING TUBES THE INLET AND OUTLET LEGS OF WHICH ARE PAIRED WITHIN THE FIREBOX

(75) Inventors: John R. Brewer, Katy, TX (US); David J. Brown, Houston, TX (US); Peter H. Brücher, Berllin (DE)

(73) Assignee: Stone & Webster Process Technology, Inc., Houston, TX (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/076,580

(22) Filed: May 12, 1998

Related U.S. Application Data

(60) Provisional application No. 60/046,383, filed on May 13, 1997.

(51) Int. Cl.[7] ..... F28D 7/00; F28D 7/06; F28D 7/08; C10G 9/14; C10G 9/18

(52) U.S. Cl. ..... 422/200; 422/196; 422/197; 422/198; 422/204; 196/110; 196/116

(58) Field of Search ..... 422/196, 197, 422/204, 198, 200; 196/110, 116; 122/235.23, 235.15

(56) References Cited

U.S. PATENT DOCUMENTS

| | | | | | |
|---|---|---|---|---|---|
| 3,672,847 | A | * | 6/1972 | Esselink | 422/197 |
| 3,847,567 | A | * | 11/1974 | Kalina et al. | 558/733 |
| 4,455,394 | A | * | 6/1984 | Pinto | 518/704 |
| 4,999,089 | A | * | 3/1991 | Nakase et al. | 196/110 |
| 5,139,650 | A | * | 8/1992 | Lenglet | 208/132 |
| 5,147,511 | A | * | 9/1992 | Woebcke | 196/110 |
| 5,151,158 | A | * | 9/1992 | Bowen et al. | 196/110 |
| 5,271,809 | A | * | 12/1993 | Holzhausen | 196/110 |
| 5,817,226 | A | * | 10/1998 | Lenglet | 208/130 |

FOREIGN PATENT DOCUMENTS

WO 95/07959 * 3/1995

* cited by examiner

*Primary Examiner*—Marian C. Knode
*Assistant Examiner*—Alexa A. Doroshenk

(57) ABSTRACT

The present invention provides a furnace and process that relies on a multiplicity of radiant heating tubes, each in the form of a U-shaped coil, that are mounted within a furnace firebox such that an inlet leg of any one of the plural tubes is immediately adjacent and spaced apart from an outlet leg of another one of the plural tubes within the firebox of a thermal cracking furnace. This spacial pairing of an inlet leg of one tube with an outlet leg of another tube of the plural radiant heating tubes of the cracking furnace maximizes utilization of the available radiant heat within the firebox of a thermal cracking furnace while reducing the likelihood of localized hot spotting that could produce coke-tar plugging of a tube.

5 Claims, 5 Drawing Sheets

CRACKING FURANCE HAVING RADIANT HEATING TUBES THE INLET AND OUTLET LEGS OF WHICH ARE PAIRED WITHIN THE FIREBOX

CROSS-REFERENCE TO RELATED APPLICATIONS

This application claims benefit of and priority to U.S. Provisional Application No. 60/046,383 filed May 13, 1997, for which the inventors and title are the same as the present patent application.

FIELD OF THE INVENTION

This invention relates to furnaces for thermally cracking hydrocarbons. More particularly, the invention relates to a furnace and process for cracking hydrocarbons wherein a particularized arrangement of radiant heating tubes is employed.

BACKGROUND OF THE INVENTION

It has long been known to thermally crack hydrocarbons to produce olefins and other lighter hydrocarbon products.

Typically, a thermal cracking furnace is comprised of a firebox containing a plurality of radiant heating tubes, each tube being formed into a U-shaped coil form, that extend through the volume of the firebox. A hydrocarbon feedstock is introduced into the cracking furnace through an inlet leg of a radiant heat tube and during transit through the tube is elevated by radiant heating of the tube to high temperatures, e.g. 1600° F. during flow of the hydrocarbon from the inlet leg to an outlet leg of that furnace tube whereupon a cracked gas product is formed that is routed by the outlet leg of the tube to a quenching system which quenches the hot reaction gas to a lower temperature to yield cracked products. Unfortunately, the nature of the thermal cracking process also causes coke and tar to form along with desired hydrocarbon products. From the beginning of the practice of thermal cracking, fouling of the furnace tubes resulting from coke and tar generation has been a serious problem. When the coiled furnace tubes are fouled by coke and tar, the cracking furnace must be taken out of service to clean or replace the tubes.

As thermal cracking technology has advanced, a trend to high severity cracking has occurred in order to achieve either improved yields or increased selectivity to the desired ultimate hydrocarbon product. As a result, thermal cracking furnaces having small diameter, short length furnace tubes in the form of U-shaped coils were developed for high severity cracking to attain higher olefin selectivity. However, practice has shown that under high severity cracking conditions the coking problem becomes even more pronounced.

The conventional wisdom now prevailing in thermal cracking is that with short residence times, high severity cracking will produce the highest selectivity and olefin yield. However, under high severity cracking conditions the coking problems increase and the operational run length consequently decreases, causing shorter effective operational ability and curtailed equipment life.

SUMMARY OF THE INVENTION

Maximization of olefin output, defined as the product of average cracking cycle yield and average furnace availability, can be achieved over the long run by a furnace and process that uses the maximum available radiant heat.

The present invention provides a particular arrangement of the inlet and outlet legs of the plural radiant heating tubes of a furnace which maximizes the use of available radiant heat within the firebox and minimizes fouling of the tube coils resulting from coke and tar formation during thermal cracking. The present invention provides a furnace with a maximum utilization of radiant heat and with a minimization of local coking problems within the tubes of the furnace.

The present invention provides a furnace and process that relies on a multiplicity of radiant heating tubes, each in the form of a U-shaped coil, that are mounted within a furnace firebox such that an inlet leg of any one of the plural tubes is immediately adjacent to and spaced apart from an outlet let of another one of the plural tubes within the firebox of a thermal cracking furnace. This spacial pairing of an inlet leg of one tube with an outlet leg of another tube of the plural radiant heating tubes of the cracking furnace maximizes utilization of the available radiant heat within the firebox of a thermal cracking furnace.

To these ends, a furnace has been developed with a radiant heating zone fired by any combination of wall and floor burners and having a common external manifold from which a preheated hydrocarbon feedstock is distributed for flow to and through the plural furnace tubes. The radiant heating tube assembly for the furnace comprises a plurality of U-shaped radiant heating tubes the inlet legs of which are communicatable with the common inlet manifold, the inlet leg of each tube being located within the firebox of the furnace and extends throughout the firebox volume to a point at which the tube coils to form a vertical U-shaped section to yield a tube outlet leg which extends throughout the firebox volume in a direction opposite that of its respective inlet leg, with the outlet leg of each such tube extending to a point terminating outside of the firebox for connection to a quench exchanger system. The plural furnace tubes, each comprising an inlet and outlet leg which communicate with one another through the U-shaped coil section of the tube, are positioned and fixed with respect to one another such that within the firebox of a furnace an inlet leg of any one of the plural tubes is immediately adjacent to and spaced apart from an outlet leg of another one of the plural furnace tubes. This inlet-outlet leg pairing between the plural radiant heating tubes permits of a more uniform spacing between the legs of the plural tubes within the firebox while minimizing the occurrence of localized thermal gradients within the firebox which would detract from the uniformity of thermal conditions therein and/or create spots of localized overheating at points along the firebox flow length of a tube. This more uniform spacing between the legs of the plural furnace tubes within the firebox further provides for an optimum exposure of the exterior surface area of the inlet legs of all of the plural furnace tubes to the radiant heating surfaces within the firebox volume of the furnace and thus maximizes the utilization of the available radiant heat within the firebox of the furnace. This provides for a greater thermal efficiency for operations of the furnace to a given degree of severity of cracking and/or selectivity of conversion of hydrocarbon feedstock to the desired ultimate product, particularly olefin products.

The process proceeds by delivering preheated hydrocarbon feedstock to a common external manifold for equilibration of temperature and pressure of the feedstocks and thereafter from the common external manifold such preheated feedstock is passed by venturi control to an inlet leg of each of the plural furnace tubes to flow therethrough to and through the U-shaped coil section of the tube to the outlet leg of the tube, during which time the feedstock becomes heated to a high temperature and cracks to form a reaction product gas which exits the furnace by flow through the outlet leg of a tube to a quench exchanger system. The heat generated by the burners within the firebox of the furnace provides radiant heat for the cracking operation. The pairing of the inlet and outlet legs of the plural furnace tubes provides for a more uniform temperature profile within the firebox, which lessens the likelihood of localized spot overheating of a tube portion that would promote coking and tarring thereat, and further enhances the thermal efficiency of furnace operations.

The cool inlet-hot outlet leg pairing of the furnace tubes of this invention differs in many beneficial respects from prior designs wherein cool inlet legs are grouped in spacings of one to another and hot outlet legs are grouped in spacings of one to another and the inlet bank of legs is widely spaced from the outlet bank of legs. With the cool inlet-hot outlet leg pairing of this design, as noted, an essentially uniform spacing exists between all legs of the multiple furnace tubes. As noted, this uniformity of leg spacing maximizes the utilization of the radiant heat which is available within the firebox and also promotes the more uniform radiant heating of each individual U-coil tube of the multiple furnace tubes. Also, this design provides for a greater concentration of tubes within the volume of space available within the firebox, meaning a greater rate of product production as a unit of firebox volume or as a unit of the heat duty for operation of the firebox. Further, product yield is more optimum since each furnace tube, being more uniformly heated, produces therein a more uniform conversion of the hydrocarbon feed therethrough to the design product. Accordingly, with design of this invention there results a cracking furnace the operation of which produces a greater production of product of more optimum product profile with an attendant greater availability and run length time for furnace operation.

BRIEF DESCRIPTION OF THE DRAWINGS

This invention will be better understood when considered with the following drawings wherein.

DESCRIPTION OF THE PREFERRED EMBODIMENTS

This invention comprises an assembly of a multiplicity of radiant heating tubes for a thermal cracking furnace wherein the plural tubes are positioned and fixed in space, one with respect to another, such that an inlet leg of any one of the plural tubes is immediately adjacent to and spaced apart from an outlet leg of another one of the plural tubes of the assembly. This plural tube assembly having paired inlet-outlet legs of the plural tubes may be positioned within a firebox of a thermal cracking furnace, either as a retrofit operation or as an element of new furnace design and construction, and thus provide a thermal cracking furnace of enhanced performance. Structures and means for positioning and suspension of such tube assembly within the volume of a furnace firebox are described which maintain a stability of the tube assembly within the firebox during that thermal cycling, with its attendant thermal expansions and contractions, which is typically encountered in operation of a thermal cracking furnace. The tube assembly of this invention provides for a maximum utilization of the radiant heat energy available within the firebox of a thermal cracking furnace, particularly a furnace which is fired solely by floor burners.

Figure 1:
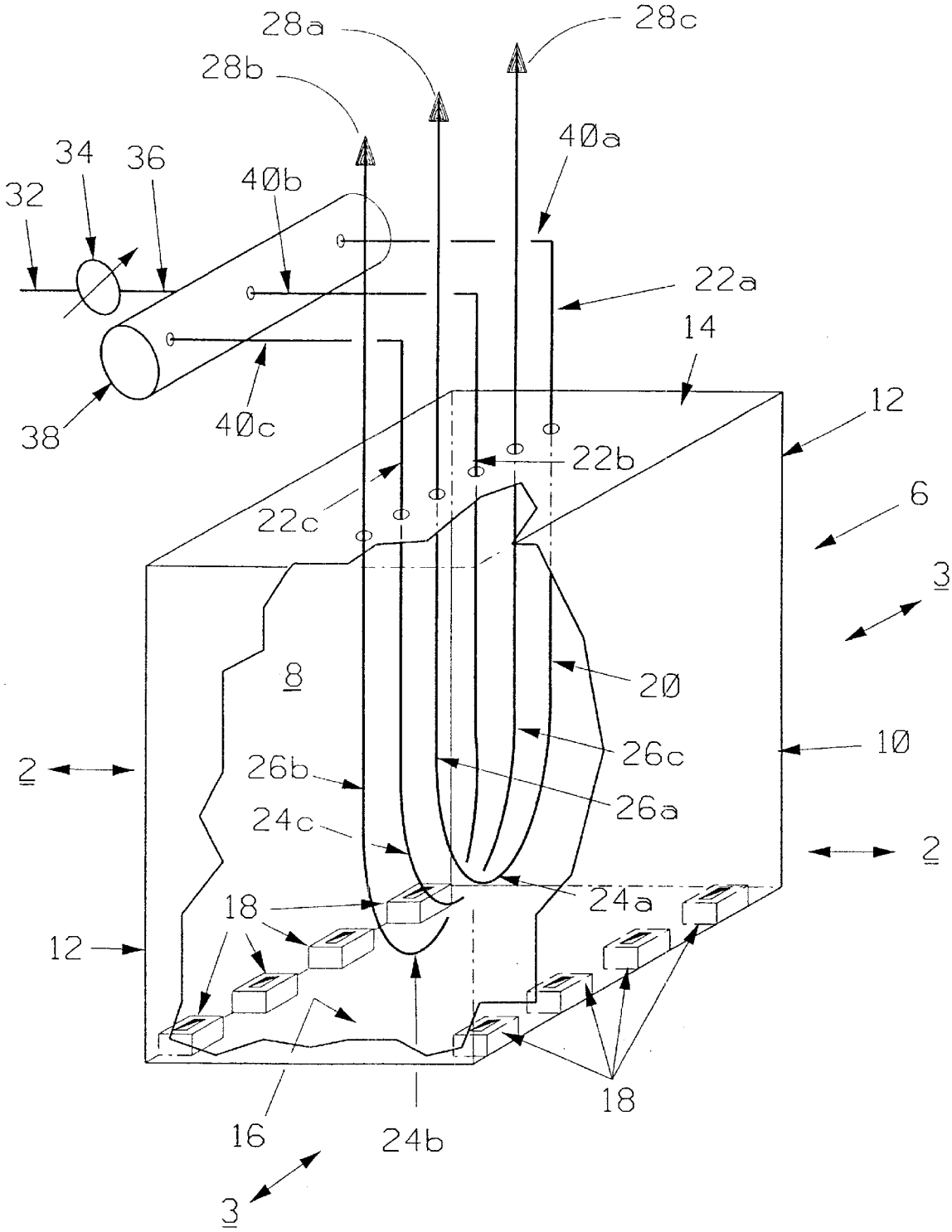
FIG. 1 is a perspective view, with partial cut away of some surfaces, of a furnace firebox containing an assembly of radiant heating tubes having a paired inlet leg-outlet leg arrangement according to this invention wherein the firebox is heated by floor burners.
Figure 2:
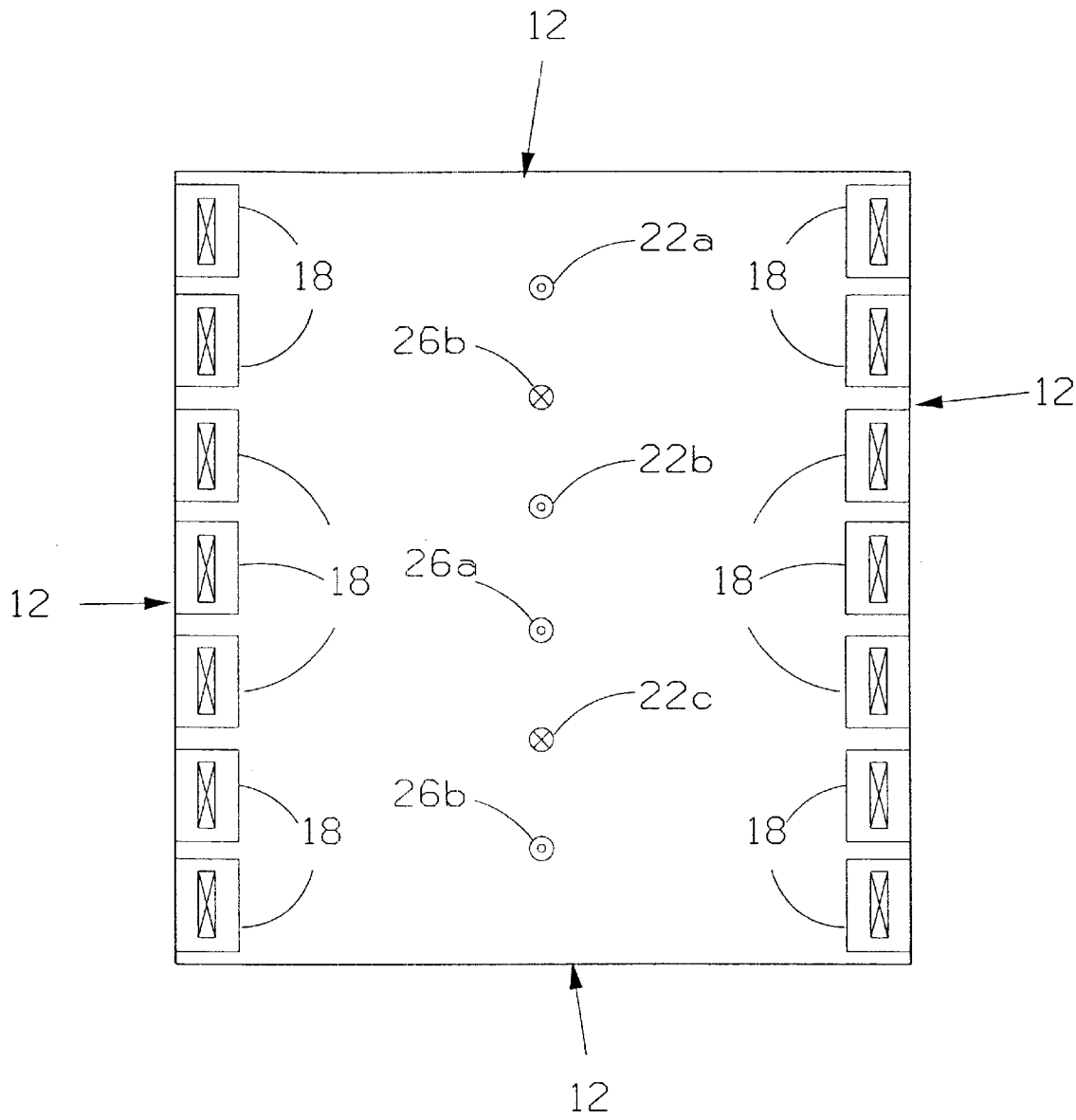
FIG. 2 is a top plan view of the furnace firebox arrangement of FIG. 1, taken along line 2—2 thereof, and schematically illustrates the inlet-outlet leg pairing of the plural radiant heating tubes as well as the floor burners of the firebox.

With reference to FIG. 1, a thermal cracking furnace 6 is schematically illustrated which comprises a radiant zone 8 defined by the firebox 10 of the furnace. The furnace firebox is defined by sidewalls 12, roof 14 and floor 16. Radiant heat is provided within the firebox by floor burners 18 as are also illustrated in FIG. 2. Similar arrangements are possible with a wall burner fired firebox or a firebox having a combination of wall and floor burners. External of the firebox 10 of the furnace is a manifold 38 into which a hydrocarbon feedstock supplied by line 32 which has undergone preheating by heat exchanger 34 is supplied. In the external manifold 38 the preheated feedstock equilibrates in temperature and pressure prior to being fed therefrom to radiant heating tubes located within the firebox of the furnace. In FIG. 1, for simplicity, only three radiant heating tubes 20 are schematically illustrated (and identified a, b and c); but it is to be understood that a greater number of such radiant heating tubes will typically exist within firebox 10 of the furnace as will hereafter be described in greater detail with reference to other figures. Further, it is to be understood that multiple tube assemblies having such paired inlet-outlet leg arrangement may be nested one with another such that the last leg of one assembly is paired with a first leg of an adjacent tube assembly so as to provide a paired inlet-outlet leg pairing between the tube assemblies. Typically, a tube assembly will comprise from 3 to 9 tubes, preferably 5 to 7, and the desired number of total tubes for the firebox is readily provided by appropriate nestings of multiple tube assemblies. Each radiant heating tube comprises an inlet leg 22(*a–c*), a U-shaped coil section 24(*a–c*) which merges into an outlet leg 26(*a–c*). For each of the plural radiant heating tubes there exists a supply line 40 which communicates the inlet leg 22 of that tube to common manifold 38. Further, for each radiant heating tube the outlet leg 26 of that tube extends through the firebox volume and through roof 14 of the firebox 10 to terminate at a point 28(*a–c*) outside of the firebox which enables this terminus point 28(*a–c*) of an outlet leg to be connected to and communicated a quench exchanger (not illustrated in FIG. 1).

As better illustrated in FIG. 2, the furnace illustrated is one the firebox 10 of which is fired entirely by floor burners 18 which provide radiant heat to the vertically disposed section of the firebox and hence to the radiant heating tubes 20 located therein. As further illustrated in FIG. 2, there is illustrated along a center line of the firebox the respective inlet leg 22 and the respective outlet leg 26 of a plurality of tubes (a–c).

Figure 3:
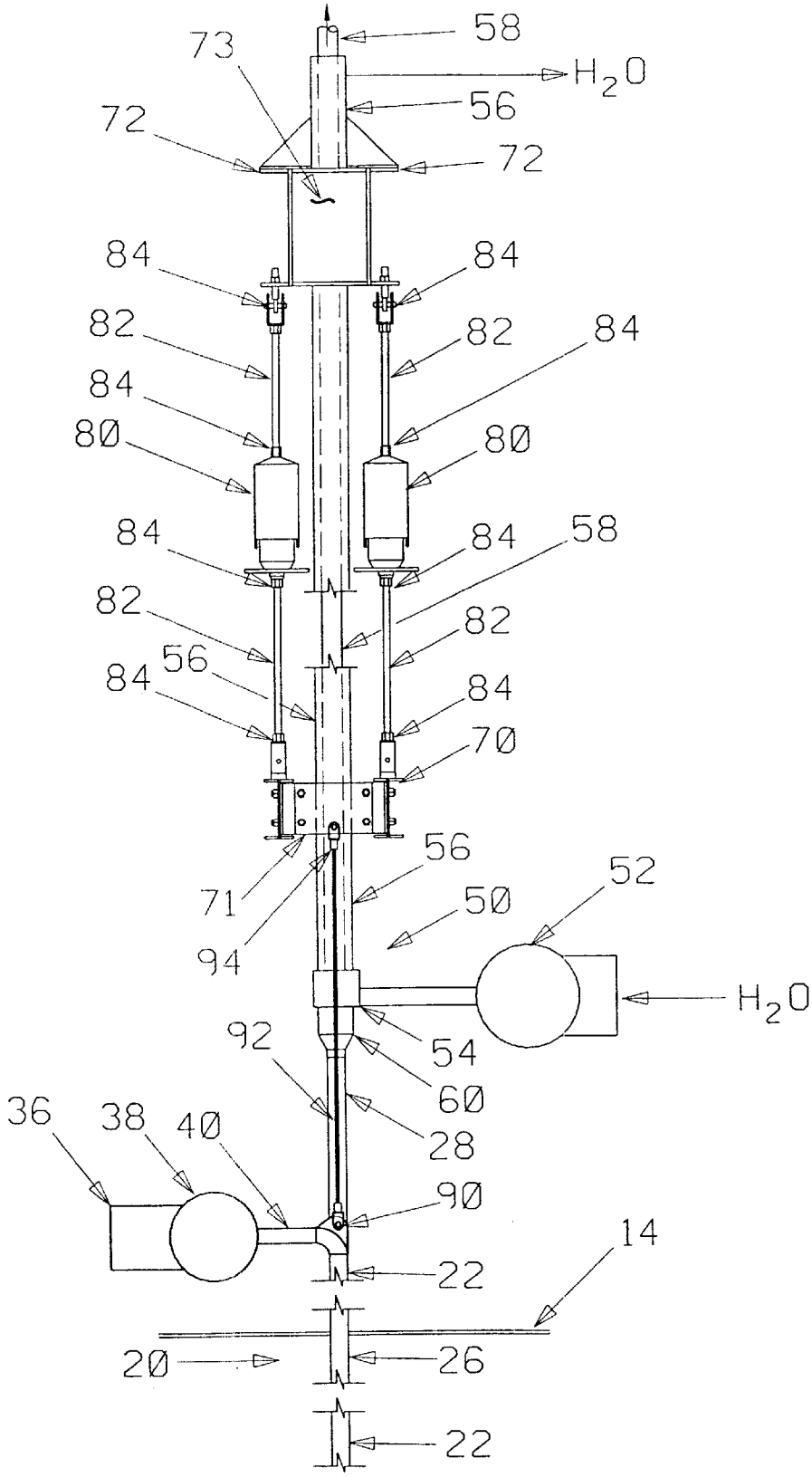
FIG. 3 is a side view, taken along line 3—3 of FIG. 1, which illustrates with some partial cut outs, aspects of the structures and means by which support is provided to suspend the plural tube assembly within the firebox volume of the furnace.

FIG. 3 better illustrates by side view structures and means for suspending and supporting the plural tubes 20 with firebox 10 and also the external features of the quench exchanger to which each terminus 28 of a tube outlet leg 26 is ultimately connected. The quench exchanger is essentially a double pipe heat exchanger wherein water which is cool relative to the temperature of the hot product gas is flowed within an annular space existing between the inner wall of the outer pipe and the outer wall of the contained coaxial inner pipe and hot reaction gases flow within the coaxial inner pipe. In FIG. 3 this quench exchanger system 50 comprises a water supply manifold 52 and distribution manifold 54 which distributes water to the annular space between the shell outer pipe 56 and coaxial inner pipe 58 of each quench exchanger which services the outlet product gases flowing from an outlet leg 26 to terminus point 28 of a radiant heating tube 20 which is operatively connected to its quench exchanger 50 by connector 60.

Structural load bearing support members 70 and 72, such as I-beams or frames formed from channel elements which form a scaffolding housing/structure for the overall operating unit, bear cross tie structural load support members 71 and 73, respectively, which both maintain the spacing and provide the load bearing support for the double tube quench exchanger members 50. The upper support member 72 is fixed, the lower support member 70 is floatable with respect thereto by reason of its resilient-flexible suspension through means of resilient load supporters 80 which are secured between fixed member 72 and floatable member 70 by connector rods 82 and anchor point attachment means 84.

Further, as illustrated in FIG. 3, this load bearing suspension means is also utilized to provide suspension support for the inlet legs of the radiant heating tubes 20 within the firebox 10. Accordingly, an elbow point connector 90 may be securely affixed at the juncture between hydrocarbon feedstock supply line 40 with an inlet leg 22 of a reaction tube 20 and connected by a connection load support rod 92 through an anchor point connection 94 affixed to a crosstie member 71 in the lower floating load support unit defined by members 70 and the crosstie 71 thereof.

By this structure and means for supporting and suspending all inlet legs 22 and outlet legs 26 of the multiple radiant heating tubes 20 within firebox 10 of a thermal cracking furnace 6 those contraction and/or expansions which are typically encountered in operation of a furnace are readily accommodated.

Figure 4:
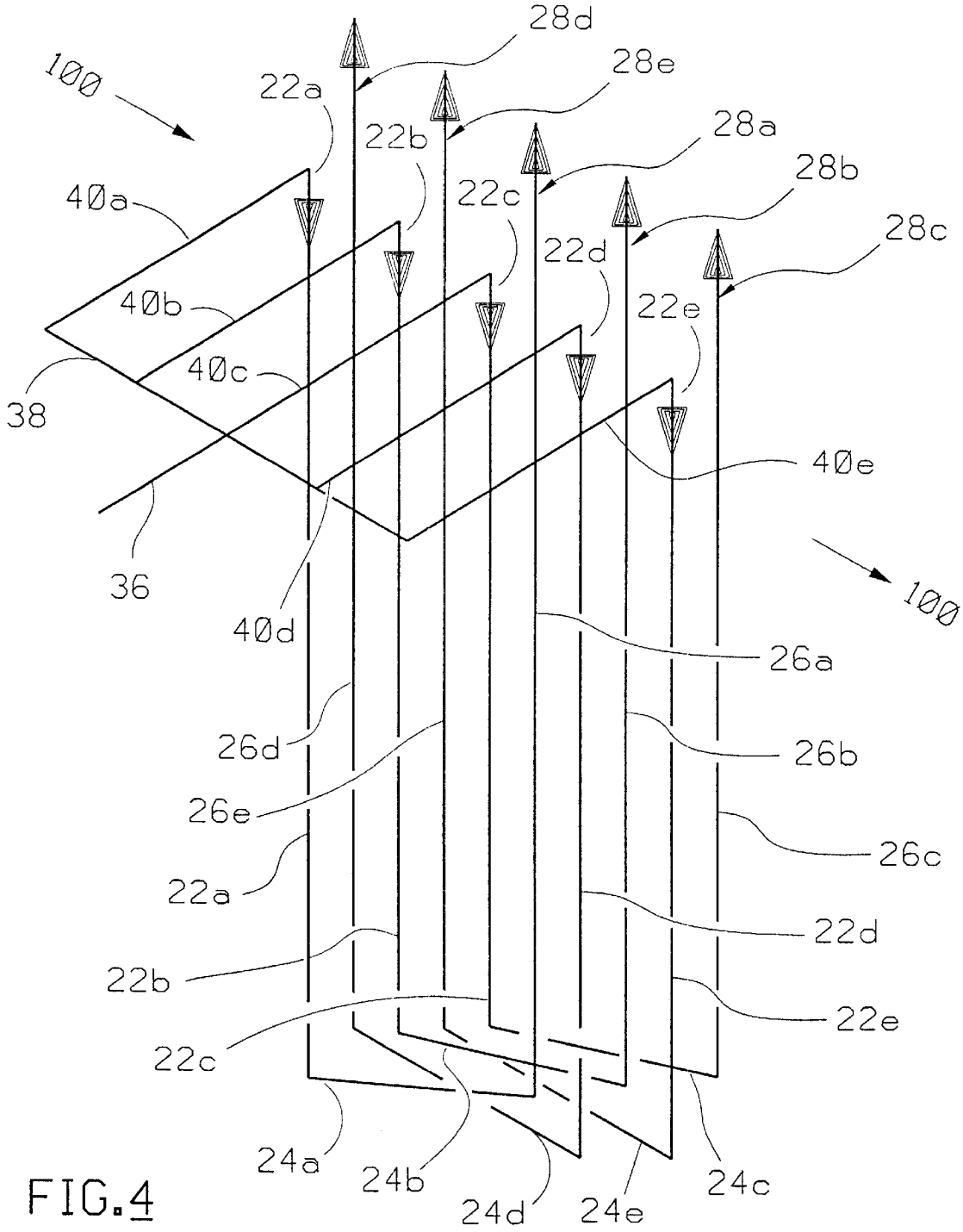
FIG. 4 is a schematic illustration of an assembly of five radiant heating tubes wherein in all cases the inlet leg of one is paired in space adjacent to the outlet leg of another of the plural tubes of the assembly.

FIG. 4 schematically illustrates the spacial arrangement of a plurality of radiant heating tubes, for simplicity of illustration five such coiled tubes are illustrated as a, b, c, d and e. For each tube illustrated in FIG. 3 the hydrocarbon feedstock supply lines 40, *a–e* respectively, which communicate the inlet leg, 22*a–e* respectively, of each of the plural tubes to common manifold 38 which is supplied with preheated hydrocarbon feed 36 is illustrated. Also illustrated for each of the plural tubes is the U-shaped extension thereof, 24*a–e* respectively, and the outlet leg of each tube, 26*a–e* respectively, as is the terminus point 28*a–e* of each outlet leg. As will be seen from FIG. 4, the inlet and outlet legs of the plural tubes lie in a common plane 100 and enter or exit the firebox 10 along a common line and for any given inlet leg 22 of any tube there is immediately adjacent thereto an outlet leg 26 of another tube. Not illustrated by FIG. 4 are the mechanical connections which space apart and hold in fixed position the inlet and outlet legs of this assembly of plural reaction tubes. Those of ordinary skill in the art will readily appreciate that such mechanical connection means as has heretofore been used in previous furnace designs for spacing apart and holding in fixed relationship the inlet and outlet legs of plural reaction tubes, albeit none heretofore have been affixed in a paired arrangement as here proposed, will function for that purpose in the tube inlet-outlet leg paired assembly design of this invention.

Figure 5:
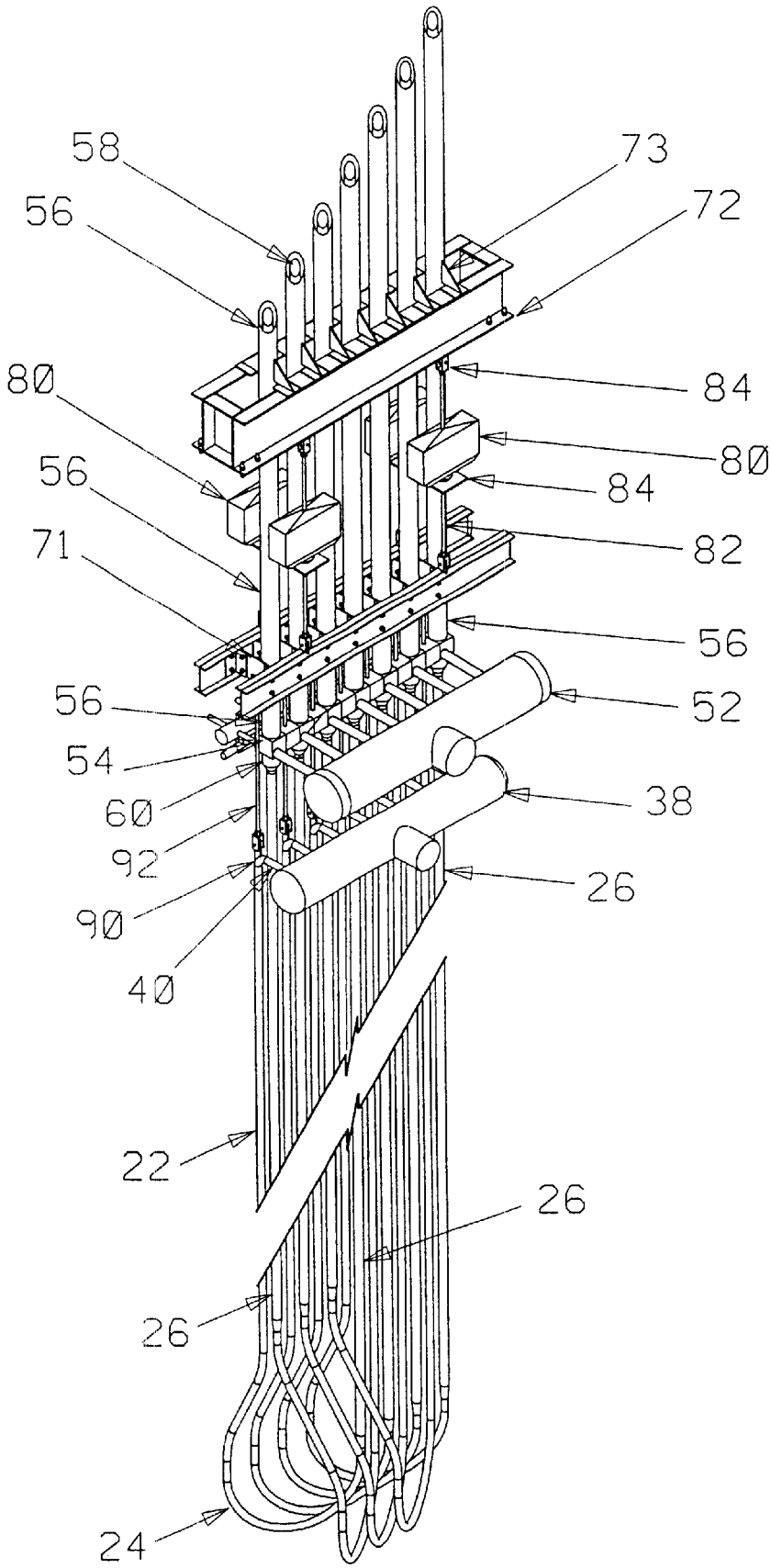
FIG. 5 is a perspective view of an assembly of radiant heating tubes having a paired inlet leg-outlet leg arrangement in conjunction with the structures and means by which the tube assembly and quench exchangers therefor are supported to suspend the plural tube assembly within the firebox volume of the furnace.

FIG. 5 illustrates in perspective view a multiple tube assembly like that described with reference to FIGS. 1, 2 and 4 in conjunction with the structures and means for supporting and suspending such tube assembly within a furnace firebox and for supporting the quench exchangers that services the tube outlet legs external of the firebox like that described with reference to FIG. 3. For convenience of illustration, in FIG. 5 the external manifold 38 is located on the same side as the water supply manifold 52 which services the quench exchangers and in this regard FIG. 5 differs from FIGS. 1 and 3, but otherwise like parts are similarly numbered.

Unlike furnace designs heretofore wherein the outlet legs which are hottest portions of the plural radiant heating tubes are collected adjacent one to another, as are the inlet legs which are coolest portions of the plural tubes, and the optimum spacing therebetween for optimum furnace performance are thus determined; in accordance with the proposal of this invention which pairs a cool inlet leg with a hot outlet leg of the plural radiant heating tubes in all occasions, the greatest uniformity of temperature (hence heat quantity) is achieved on any local point or spot basis. Thus not only reduces the likelihood of localized point or spot coking/tarring within any individual reaction tube; this uniformity also provides for a closer spacing to be utilized between all inlet and/or outlet legs of the plural reaction tubes within the firebox and thus provides for a greater concentration of tubes to be located within the firebox volume. This more uniform spacing between the radiant heating tube legs means that any given inlet tube leg will be "shadowed" to a lesser extent than heretofore by any leg of another tube while the outlet tube leg of any tube will only be slightly more "shadowed" by any other leg of another tube than heretofore. Hence, a greater surface area of any inlet leg of any tube is exposed to the radiant heating surfaces of the furnace firebox (radiant heating being a line of sight heating mode) meaning a greater utilization by all inlet legs of the plural tubes of that available radiant heat within the furnace firebox, all while the tendency to tube plugging by localized coke/tar formation is reduced.

The process of the present invention proceeds by delivering hydrocarbon feedstock such as ethane, naphtha, gas oil, etc. to conventional preheating equipment to preheat the feedstock to a desired preheat level and then to convey such preheated feed to common manifold 38. In general the feedstock is preheated to a temperature of from about 900° F. to about 1400° F., as measured by the temperature equilibrated feedstock content in the common manifold. From common manifold 38 the requisite quantities of preheated feedstock is supplied for distribution by critical flow venturi by a supply line 40 to the inlet leg 22 of each of the plurality of reaction tubes and flows therethrough to and through the tubes U-shape connection section 24 and into the outlet leg 26 of the reaction tube. During the transit of hydrocarbon feedstock through any given reaction tube, the temperature of the feedstock is increased from its preheat temperature of from about 900° F. to about 1400° F. to a temperature of from about 1500° F. to 1650° F. and cracking of the hydrocarbon feedstock components occurs during this time.

Although the primary means of inducing heat content into that hydrocarbon which flows through a radiant heating tube is by radiant heating of the tube itself—which in turn conducts the tube metal heat into the hydrocarbon flowing therethrough—nevertheless, the tube metal temperature of any one leg of a given tube exerts a thermal influence upon the temperature that will be experienced by the metal of an adjacent leg of any other tube thereto. This then dictates the spacings necessary between adjacent legs of the plural tube members in order to reduce the inhomogeneities of tube metal temperatures within the firebox of a furnace; or, in other words, to optimize the homogeneity of metal surface temperatures of the plural tubes within the firebox—this in turn to maximize to the extent possible the homogeneity of the hydrocarbon temperature during its transit through the firebox volume.

In the plural tube assembly design of the invention, wherein there is always a pairing of a cooler inlet leg with an immediately adjacent in space hotter outlet leg of any given leg pair of radiant heating tubes within the firebox of the furnace, the optimum in heat transfer and temperature of flowing hydrocarbon therethrough is achieved; this because there is immediately adjacent in space one to another of the coolest and hottest legs of said plural tubes (for the most rapid heat transfer therebetween) which leads to the allowability of an essential uniform spacing therebetween (for maximum utilization by the inlet legs of the tubes of the radiant heat available within the furnace firebox) with minimum likelihood of localized hot spot occurrence at any point along the length of any of the plural heating tubes (hence, minimizing the possibility of coking/tarring thereat).

The foregoing disclosure and description of the invention are illustrative and explanatory thereof, and various changes in the details of the illustrated apparatus and construction and method of operation may be made without departing from the spirit of the invention.

What is claimed is:

1. A thermal cracking furnace, comprising:

a firebox;

multiple radiant heating tubes, each tube comprising an inlet leg, an outlet leg, and a U-shaped coil tube section communicating said inlet leg to said outlet leg, said radiant heating tubes being positioned and fixed in space with respect one to another such that in a plane within said firebox that is common to all legs of said multiple radiant heating tubes each inlet leg thereof is immediately adjacent in space to an outlet leg thereof; and wherein the outlet leg of each tube terminates at a location outside the firebox of said furnace.

2. The thermal cracking furnace of claim 1, wherein external of the firebox of said furnace is located a manifold which supplies each inlet leg of each tube with preheated hydrocarbon feedstock.

3. The thermal cracking furnace of claim 2, wherein external of the firebox of said furnace is located a quench exchanger to receive cracked product gas flowing from an outlet leg terminus of each tube.

4. The thermal cracking furnace of claim 1, wherein radiant heat is supplied within said firebox by floor burners.

5. The thermal cracking furnace of claim 4, wherein the spacing between any pair of legs is essentially uniform.

* * * * *